United States Patent [19]

Walz

[11] 4,337,418

[45] Jun. 29, 1982

[54] STARTER UNIT FOR GAS DISCHARGE LAMPS POWERED BY ALTERNATING-CURRENT MAINS

[76] Inventor: Alfred Walz, Am Kurzarm 7, 7830 Emmendingen, Fed. Rep. of Germany

[21] Appl. No.: 133,939

[22] Filed: Mar. 25, 1980

[30] Foreign Application Priority Data

Apr. 4, 1979 [DE] Fed. Rep. of Germany ..... 2913525

[51] Int. Cl.[3] ..... H05B 37/02; H05B 39/06; H05B 41/04; H05B 41/18

[52] U.S. Cl. ..... 315/362; 315/102; 315/104; 315/DIG. 2; 315/DIG. 5

[58] Field of Search ..... 315/362, DIG. 5, DIG. 2, 315/DIG. 7, 86, 102, 104

[56] References Cited

U.S. PATENT DOCUMENTS

| | | | |
|---|---|---|---|
| 3,801,794 | 4/1974 | Mauch et al. | 315/362 |
| 3,858,087 | 12/1974 | Tomsky et al. | 315/86 |
| 3,890,540 | 6/1975 | Ott | 315/DIG. 5 |
| 4,100,462 | 7/1978 | McLellan | 315/362 |

FOREIGN PATENT DOCUMENTS

| | | |
|---|---|---|
| 92763 | 6/1971 | Fed. Rep. of Germany . |
| 2116812 | 10/1972 | Fed. Rep. of Germany . |
| 1639108 | 8/1973 | Fed. Rep. of Germany . |
| 465058 | 12/1968 | Switzerland . |
| 1363749 | 8/1974 | United Kingdom . |

*Primary Examiner*—Saxfield Chatmon, Jr.
*Attorney, Agent, or Firm*—Browdy and Neimark

[57] ABSTRACT

A starting circuit for gas discharge lamps, such as fluorescent lamps, includes a relay coil controllable switch. A rectifier-multiplier has its input connectable to the alternating-current mains via the controllable switch. A polarity-reversing switch is coupled to an output from the rectifier-multiplier for supplying direct-current to electrodes of at least one gas discharge lamp. Devices responsive to energization of the mains effect reversal of the polarity-reversing switch upon each energization of the mains. A time-delay relay responsive to each energization of the mains effects the closing of the relay coil controllable switch subsequent to each polarity-reversing action of the polarity-reversing switch.

8 Claims, 1 Drawing Figure

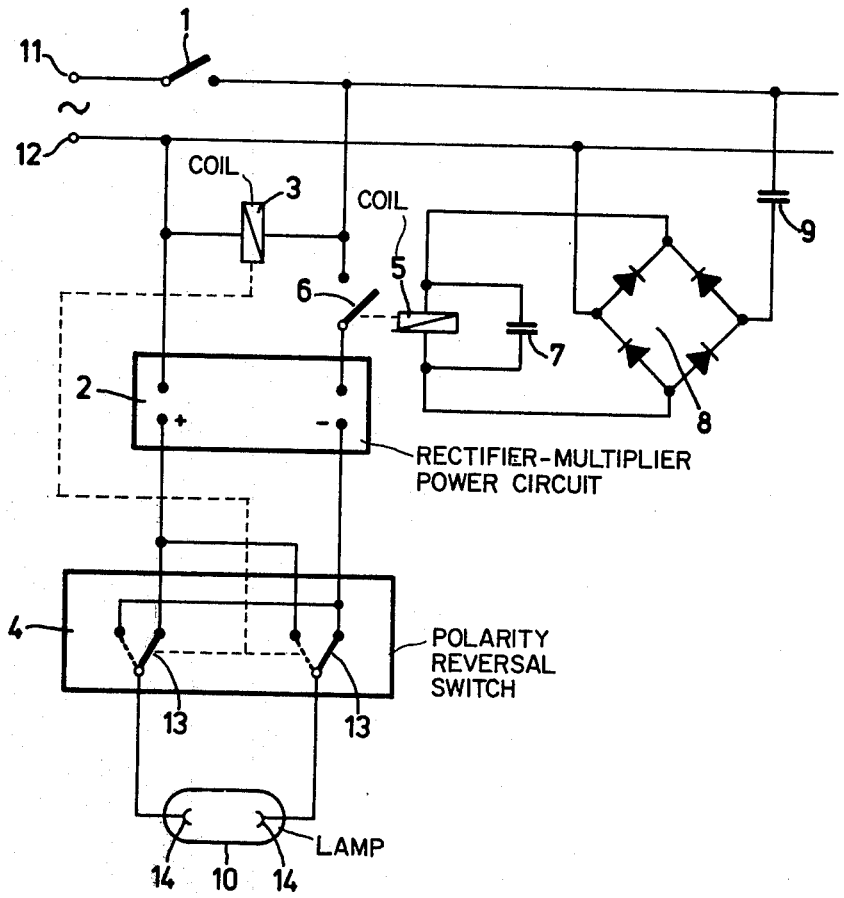
1
11
12
COIL
3
COIL
5
6
7
8
9
2
+
-
RECTIFIER-MULTIPLIER
POWER CIRCUIT
4
POLARITY
REVERSAL
SWITCH
13
13
LAMP
14
10
14

STARTER UNIT FOR GAS DISCHARGE LAMPS POWERED BY ALTERNATING-CURRENT MAINS

FIELD OF THE INVENTION

The invention relates to a starter unit for gas discharge lamps powered by alternating-current mains, in particular fluorescent lamps, having a rectifier-multiplier circuit and a polarity reversal switch, wherein the polarity reversal switch is actuated in a load-free manner.

BACKGROUND OF THE INVENTION

A starter or choke unit of this kind is known from Swiss Pat. No. 465,058. In this unit, a snap toggle switch is used which is actuated mechanically by means of a tilting spring. The snap toggle switch is actuated after the power-supply switch has been opened. The polarity reversal exciter coil of the snap toggle switch is exposed to the direct current of the lamp. However, the contact device is not moved thereby; instead, a movement of the relay armature only tenses the spring. Only when the electrical circuit of the lamp is broken by a shutoff of the power supply does the lamp current gradually drop to zero, after the discharge of the capacitances of the rectifier-multiplier circuit; and only then does the polarity reversal spring throw over the contact device of the snap toggle switch, in a practically load-free manner. Nevertheless, the switchover is not entirely load-free, and scorching of the contacts thus occurs. Furthermore, each line of lamps requires a suitably adapted polarity reverser exciter coil.

In another known apparatus for supplying power to gas discharge lamps (East German Pat. No. 92,763), all the switching elements are disposed in a metal housing embodied by a starter or choke coil, wherein a short-circuit element is provided. When the apparatus is switched on, the short-circuit element is drawn up, so that the armature movement can be utilized in order to actuate a switchover device when the gas discharge lamp is switched on or off, thus preventing the occurrence of cataphoresis.

Finally, in a further known apparatus for powering gas discharge lamps (West German laid-open application 2 116 812), a pushbutton reversal switch which is actuated with the aid of an electromagnet is provided as the switchover device.

The operation of gas discharge lamps on an alternating-current power supply via rectifier-multiplier circuits has major advantages as compared with direct-current operation; specifically, there is an energy saving of up to 30% resulting from the avoidance of recombination losses in the gas discharge path at each half-wave of the 50 Hz alternating-current power, and reduced losses in structural components of the rectifier-multiplier circuit as compared with copper and iron losses in known starter units. The rectified power supply enables flicker-free burning of fluorescent lamps, without a stroboscopic effect. A rectifier-multiplier circuit of this kind is known from West German Pat. No. 1,639,108 and enables direct starting. In long discharge lamps, that is, those having a length of over ca. 60 cm, however, a mercury vapor shift (cataphoresis) occurred, which can cause impoverishment of the mercury component in the anode region, which reduces the light yield. It has already been proposed to prevent this cataphoresis by means of mercury vapor equalization.

SUMMARY OF THE INVENTION

The subject of the present invention is a starter unit in which cataphoresis is prevented by means of a polarity reversal upon each occurrence of switching on the fluorescent lamps.

In this unit, contact actuation must be accomplished in a load-free manner, so that the contact service life, which is critical in direct-current operation, will correspond to the service life of the fluorescent lamps, which is in the order of magnitude of 20,000 to 30,000 hours.

It is accordingly a principal object of the invention to embody a starter unit of the type described at the outset in such a manner that polarity reversal occurs in a load-free manner, without mechanical means such as tilting springs, magnets or the like.

This object is essentially attained according to the invention in that the rectifier-multiplier circuit, after actuation of a master power-supply switch, is switched on in delayed fashion relative to the polarity reversal switching process by means of a relay coil having a working contact and a capacitor switched in parallel thereto.

The polarity reversal contact device, having by way of example a relay coil for 220 V of alternating current, pulls up within one half-period, that is, within approximately 10 msec at 50 Hz alternating current. As a result of the embodiment according to the invention, the rectifier-multiplier circuit is connected to the mains voltage later than after the elapse of 10 msec; for example, it may be connected at the earliest after the elapse of 50 msec, which is 2.5 alternating-current periods, but it is efficient to connect it no later than after 100 msec.

It is particularly efficient for a bipolar, electromagnetic, double-throw current surge switch to act as the polarity reversal switch.

A particularly advantageous effect is attained when the starter unit according to the invention is used in combination with fluorescent tubes having sintered electrodes.

In an advantageous manner, the relay coil of the delay switch is supplied with power via an auxiliary rectifier source, which is connected directly to the mains voltage.

A capacitor is advantageously provided in a supply line leading to the auxiliary rectifier source for the purpose of current limitation.

Further details and advantages of the invention, as well as its mode of operation, will be explained with the aid of the drawing.

BRIEF DESCRIPTION OF THE DRAWING

The single FIGURE of the drawing shows in schematic form one exemplary embodiment of the invention.

DESCRIPTION OF THE PREFERRED EMBODIMENT

The starter unit according to the invention is connected to alternating-current mains, having mains voltage lines 11 and 12. A master power-supply switch 1 serves to connect the unit to the mains alternating current. Connected to the lines 11 and 12 is a rectifier-multiplier circuit 2, which is connected via a contact system 4 of a polarity reversal switch with the electrodes, for instance sintered electrodes 14, of a gas discharge lamp 10, for instance a fluorescent lamp.

A relay coil 3 serves the purpose of polarity reversal of the contact system 4 having the reversal contacts 13. At each current surge, which is caused by the actuation of the master power switch 1, the relay coil 3 effects a switchover of the reversal contacts 13 of the contact system 4 of the polarity reversal switch.

A normally open working contact 6 of a relay is disposed in a supply line of the rectifier-multiplier unit 2. The exciter coil 5 for contact 6 is supplied with power via a rectifier bridge circuit 8. A capacitor 7 is disposed parallel to the exciter coil 5.

When the mains voltage is switched on with the master power switch 1, the reversal contacts 13 are switched over in a load-free manner, because the rectifier-voltage-multiplier unit 2 is still not functioning, because the working contact 6 is still open. By means of an appropriate selection of the capacitance of the capacitor 7, the delay in the actuation of the working contact 6 can be selected to be approximately 3 to 5 times longer than the operating time of the relay 3; that is, delays of approximately 30 to 50 msec can be attained.

Before the direct current generated by the rectifier-voltage-multiplier unit 2 is established and ignition of the fluorescent lamp 10 can begin, the polarity reversal switch has a polarity which is transposed relative to that of the preceding operating period. When the lighting system is switched off with the master power switch 1, the exciter coil 3 of the current surge polarity reverser 4 becomes free of electrical current; however, the contact device 4 remains in its same position. The relay having the exciter coil 5 and the working contact 6 which is excited via the rectifier bridge circuit 8 deenergizes in delayed fashion and interrupts the mains current supply lines as a supplement to the mains interruption effected by the master power switch 1. When the starter unit is connected anew to the mains by the actuation of the master power switch 1, the current surge contact reversal switch having the coil 3, which is excited without a delay, will first throw over the contact device 4 having the reversal contacts 13. Then, with the selectable delay of at least 50 msec, the connection of the rectifier-voltage-multiplier unit 2 to the mains is effected via the now-closed contact 6.

Thus, each time the master power switch 1 is closed, a load-free polarity reversal of the fluorescent lamp 10 is effected, before the lamp is ignited and caused to burn by the rectifier-voltage-multiplier circuit 2. A cataphoresis effect is thus prevented in the fluorescent lamp 10 operated on direct current.

Should a cataphoresis effect be ascertained as a result of unforeseeable circumstances (for instance, during the warm-up period of the fluorescent lamp 10, as a rule during the first 100 hours of burning), then the polarity reversal can be arbitrarily attained by means of briefly switching the master power switch 1 off and then on again. Longer delays than 100 msec should not be provided here. In an efficient manner, a current limiting capacitor 9 is further provided at the supply line to the rectifier bridge circuit 8.

In one realized exemplary embodiment of the invention, the capacitance of the current limiting capacitor 9 was 0.33 $\mu$F; the capacitance of the capacitor 7, of an electrolyte capacitor, for instance, was 10 $\mu$F; the ohmic resistance of the relay coil 3 was 4,500 Ohms, and that of the relay coil 5 was 750 Ohms.

The invention is not restricted to the exemplary embodiment illustrated and described herein. It also encompasses all derivations and further embodiments thereof which can be made by a person skilled in the art as well as partial combinations and subcombinations of the characteristics and provisions described and/or illustrated.

What is claimed is:

1. A circuit for starting and powering a gas discharge lamp, such as a fluorescent lamp, from alternating current mains using direct current power to the lamp, the combination of rectifying means, a normally open relay contact in said circuit between said rectifier means and said alternating current mains, said normally open relay contact controlling the power input to said lamp means, a polarity-reversing switch means in said circuit connected in parallel between the output of said alternating current mains and said lamp, means responsive to energization of the alternating current mains for effecting reversal of said polarity-reversing switch means upon energization of said mains, time delay relay means controlling said normally open relay contact and responsive to each energization of the mains for closing said relay contact subsequent to each operation of said polarity-reversing switching means, and said time delay relay means including a coil and a capacitor in parallel circuit to each other, said time delay relay means being wired in said circuit in a branch separate from said polarity-reversing means; whereby each reversal of said polarity-reversing switch takes place under a no-load condition immediately upon energization of said circuit, and whereby said polarity-reversing switch means is connected to said alternating current mains only after both said polarity-reversing action has taken place and after said time delay of said time delay relay means has timed out.

2. A starting circuit according to claim 1, wherein said rectifying means comprises a rectifier-multiplier.

3. A starting circuit according to either claim 1 or claim 2, wherein said polarity-reversing switch means comprises a bipolar, electromagnetic, double-throw current surge switch.

4. A starting circuit according to claim 1 or claim 2, in combination with at least one gas discharge lamp having sintered electrodes, said electrodes being connected to the output of said polarity-reversing switch means.

5. A starting circuit according to claim 1 or claim 2, including an auxiliary rectifier source, said relay coil being powered via said auxiliary power source.

6. A starting circuit according to claim 1 or claim 2, including a current limiting capacitor disposed in a supply line to said auxiliary rectifier source.

7. A starting circuit according to claim 1, wherein said polarity-reversing means and said means responsive to energization of said alternating current mains to effect reversal of said polarity-reversing switch means comprises, respectively, contact means and coil means of a single relay.

8. A circuit for starting and powering a gas discharge lamp from main power lines, such as a fluorescent lamp, comprising a first branch parallel circuit of the lamp, a polarity reversal switch means, a rectifier power circuit means, and a sensing means to sense the energization of the main power lines; a second branch circuit including time delay means having a contact positioned in said first branch parallel circuit; whereby said polarity-reversal switch means is immediately operated on energization of the sensing means, whereby the rectifier means is not activated to power the lamp until after said polarity-reversal has been accomplished, and whereby said polarity reversal is accomplished under a no-load condition.

* * * * *